US011225396B2

(12) United States Patent
Junge et al.

(10) Patent No.: US 11,225,396 B2
(45) Date of Patent: Jan. 18, 2022

(54) SHAFT HOISTING PLANT HAVING AN OVERWIND BRAKE DEVICE

(71) Applicant: OLKO-MASCHINENTECHNIK GMBH, Olfen (DE)

(72) Inventors: Matthias Junge, Wenden (DE); Lars Rietz, Attendorn (DE); Nicole Klein, Mudersbach (DE); Eduard Haberkorn, Overath (DE)

(73) Assignee: OLKO-MASCHINENTECHNIK GMBH, Olfen (DE)

( * ) Notice: Subject to any disclaimer, the term of this patent is extended or adjusted under 35 U.S.C. 154(b) by 852 days.

(21) Appl. No.: 16/071,590

(22) PCT Filed: Nov. 6, 2017

(86) PCT No.: PCT/EP2017/078310
§ 371 (c)(1),
(2) Date: Jul. 20, 2018

(87) PCT Pub. No.: WO2018/091294
PCT Pub. Date: May 24, 2018

(65) Prior Publication Data

US 2019/0031471 A1 Jan. 31, 2019

(30) Foreign Application Priority Data

Nov. 17, 2016 (DE) ..... 10 2016 122 165.1

(51) Int. Cl.
*B66B 5/08* (2006.01)
*B66B 5/28* (2006.01)
*B66B 5/26* (2006.01)

(52) U.S. Cl.
CPC ..... *B66B 5/08* (2013.01); *B66B 5/28* (2013.01); *B66B 5/26* (2013.01)

(58) Field of Classification Search
CPC ..... B66B 5/08; B66B 5/28; B66B 5/26
(Continued)

(56) References Cited

U.S. PATENT DOCUMENTS

2014/0110194 A1* 4/2014 Zhu ..... B66B 17/04 187/254
2015/0360907 A1* 12/2015 Koch ..... B66B 5/26 187/357

FOREIGN PATENT DOCUMENTS

DE 439858 C 1/1927
DE 549001 C 4/1932
(Continued)

OTHER PUBLICATIONS

Siemag Tecberg, "Technische Informationen Sicherheits-Bremseinrichtung (SSA)" [Technical Information Safety Arrestor (SSA)], published at www.siemag-tecberg.5 com, retrieved on Jun. 1, 2016.

*Primary Examiner* — Jeffrey Donels
(74) *Attorney, Agent, or Firm* — Lucas & Mercanti, LLP

(57) ABSTRACT

A shaft hoisting plant has a conveyance and an overwind brake device for the conveyance, a travel path for the conveyance, and an overwind path adjoining a lower and/or upper end of the travel path. The overwind brake device includes retaining bars arranged in pairs in a manner spaced apart from one another and extending in a longitudinal direction, energy-absorbing material arranged in the form of plates arranged one above another in the longitudinal direction between the retaining bars. A plow is movable relative to the retaining elements, such that, upon overwinding of the conveyance, the plow deforms and/or destroys the energy-absorbing material between the retaining elements.

16 Claims, 6 Drawing Sheets

(58) Field of Classification Search
USPC ..... 187/282
See application file for complete search history.

(56) References Cited

FOREIGN PATENT DOCUMENTS

| | | | |
|---|---|---|---|
| DE | 102013001405 | A1 | 7/2014 |
| GB | 1319616 | A | 6/1973 |
| GB | 1561509 | A | 2/1980 |
| GB | 1601809 | A | 11/1981 |
| SU | 623804 | A1 | 9/1978 |

* cited by examiner

SHAFT HOISTING PLANT HAVING AN OVERWIND BRAKE DEVICE

CROSS-REFERENCE TO RELATED APPLICATIONS

This application is a 371 of PCT/EP2017/078310 filed Nov. 6, 2017, which in turn claims the priority of DE 10 2016 122 165.1 filed Nov. 17, 2016. The priority of both applications is hereby claimed and both applications are incorporated herein by reference.

BACKGROUND OF THE INVENTION

The invention relates to a shaft hoisting plant having a conveyance and an overwind brake device for the conveyance, a travel path, extending in a longitudinal direction, for the conveyance, and an overwind path adjoining a lower and/or upper end of the travel path.

In mining, overwinding describes the situation in which the conveyance comes to a stop only above the bank level or the upper filling station during shaft hoisting.

In shaft hoisting plants, it is possible, in the event of a defect in the control, for the conveyance to move above the upper filling station. In this case, a safety device, which acts directly on the control of the winding machine, ensures that the winding machine is stopped. The winding machine is then shut off by the limit switch and braked via the safety brake. In the event that the limit switch does not work properly or even fails entirely, a mechanical apparatus has to greatly reduce the speed of the conveyance for safety reasons. If the conveyance travels in an unbraked manner as far as under the crash beam, this can have grave consequences right up to cable breakage. Even at a low speed of a conveyance, if the conveyance travels in an unbraked manner under the crash beam, this can be associated with serious consequences for those traveling on it.

The overwind brake device, also referred to as overwind protection system, reduces the consequences of overwinding. The overwind brake device is located at the end of the shaft guide and has a device for braking, which slows down the conveyance. The braking effect may only start above the upper filling station of the conveyance and after the limit switch has been passed. The maximum deceleration of the conveyance should not exceed a value of 9.81 $m/s^2$ for safety reasons.

In shaft hoisting plants with guide-rail guidance, guide rails that are thickened or inclined with respect to one another are used as devices for braking. The widened or pulled-together guide rails usually consist of wood. In plants with rail guidance, the devices for braking can also consist of steel.

The guide-rail thickening is embodied such that the guide rails are enlarged above and below the outermost operating position of the conveyance. This enlargement is executed symmetrically on each side of the guide rails. If a conveyance travels right into the thickened portion of the guide rails, the latter is damaged by the guide shoes arranged on the conveyance. The braking with guide-rail thickening takes place in an uncontrolled manner frequently results in the destruction of the conveyance.

Furthermore, an overwind brake device from SIEMAG TECBERG is known, in which, during braking, a braking frame having roller boxes is positively driven on flat strips. As a result of the plastic deformation of the braking strips in the roller boxes, the conveyance striking the braking frame is braked. The overwind brake device can be installed at each end of the travel path and in both winding strands. The dimensions of the flat strips are selected appropriately for the shaft hoisting plant, depending on the forces that arise. The structure of the overwind brake device from SIEMAG TECBERG is apparent from their brochure "Technische Informationen Sicherheits-Bremseinrichtung (SSA)" [Technical Information Safety Arrestor (SSA)], published at www.siemag-tecberg.com, retrieved on 06.01.2016, and from DE 10 2013 001 405 A1, paragraph [0040].

The structure of the known overwind brake device is quite complicated and therefore expensive.

DE 549 001 A discloses a shaft hoisting plant having a conveyance and an overwind brake device for the conveyance, having a travel path, extending in a longitudinal direction, for the conveyance, and an overwind path adjoining a lower and/or upper end of the travel path, referred to therein as over- and underwind zone. In the region of the overwind path, brake beams are provided, which are attached to the shaft girders or framework girders or to an auxiliary structure. Arranged on the conveyance are braking means, for example clamping tools, which come into engagement with the brake beams, which consist of any desired material, during overwinding of the conveyance.

BRIEF SUMMARY OF THE INVENTION

An object of the present invention is to provide an overwind brake device of low structural complexity, in which high follow-up costs in the event of accidental traveling of the conveyance into the overwind brake devices are avoided.

In order for the absorption material to be able to absorb the energy during braking of the conveyance, a braking path of less than 10 m is provided. Retaining elements embodied as retaining bars are fastened to the overwind path or to the conveyance in pairs and in a spaced-apart manner. Arranged between the retaining bars is energy-absorbing material in the form of plates. A plow that projects into the intermediate space between the retaining bars is arranged so as to be movable in the longitudinal direction relative to the retaining bars. The retaining bars prevent the energy-absorbing material from buckling when struck by the plow. The force transmission of the plow takes place in a targeted manner to the energy-absorbing material fixed by the retaining bars, said energy-absorbing material being deformed and/or destroyed during the linear relative movement between the plow and the retaining bars along the braking path. Insofar as the braking operation involves a deformation of the energy-absorbing material, it is a plastic deformation, in order to avoid elastic forces that oppose the braking force. The material properties of the energy-absorbing material are coordinated with the travel speed and the weight of the conveyance, including the cable weight.

The energy-absorbing material is, as already mentioned, arranged in the form of plates one above another between the retaining elements embodied as retaining bars. The plates can be arranged one above another individually or in the form of a plurality of plate stacks. The retaining bars engage preferably around the edges of the plates or plate stack arranged one above another in the longitudinal direction, i.e. in the direction of the braking path, between the retaining bars. If the conveyance accidentally travels into the overwind brake device only along a part-length of the braking path, only the plates destroyed by the plow in the process have to be replaced.

Either the plow is arranged in a movable manner and the retaining bars are arranged in a stationary manner on the overwind path or the plow is arranged in a stationary manner on the overwind path and the retaining bars are arranged in a movable manner.

In order to be arranged in a movable manner, the plow can be arranged directly on the conveyance. Alternatively, the plow can be arranged on a movable braking frame which is positively driven in the longitudinal direction of the overwind path. The braking frame is guided in particular in a guide framework of the shaft hoisting plant. The braking frame has stop surfaces which are struck by the overwinding conveyance, which, as a result, transmits the kinetic energy to the braking frame and the plow arranged thereon. In this case, the plow is coupled indirectly to the conveyance.

When the plow is arranged in a movable manner, the retaining bars are mounted in a stationary manner, preferably on the guide framework. However, it is also possible to mount the retaining bars in a stationary manner, as shaft fixtures, directly along the overwind path.

In order to be arranged in a stationary manner, the plow can be mounted directly on the guide framework. However, it is also possible to mount the plow directly, as a shaft fixture, along the overwind path. With the plow arranged in a stationary manner, the retaining bars are mounted on the movable conveyance.

Tests have shown that fiber composite materials, which comprise an embedding matrix of plastic and reinforcing fibers, are preferably used as energy-absorbing material. The fibers confer the high mechanical stability on the material, while the matrix absorbs the forces that act on account of the plow and distributes them in the microstructure. The fibers can consist of inorganic and/or organic and/or metallic material.

A particularly suitable fiber-reinforced plastic is what is known as organosheet, a continuous fiber-reinforced thermoplastic. Organosheets consist of a woven fiber fabric or a fibrous scrim which are embedded in a thermoplastic matrix; usually made of polyamides (PA) or polypropylene (PP) with glass fiber fabrics (GFRP Organo). Organosheets can also be provided with carbon and aramid reinforcements (CFRP Organo). Organosheets can be processed similarly to metal sheets, namely by thermoforming, folding or bending. The main advantages of organosheets are:

High mechanical strength with low weight
Suitable for large series production
Short process cycles during forming
Good weldability
Good chemical resistance
Recyclable
No corrosion with glass fiber reinforcements The guide framework of the overwind brake device is required to allow the conveyance to move freely in a guided manner along the provided braking path during overwinding. To this end, the guide framework has a plurality of, for example four, vertical support girders and an upper and a lower brace, which each consist of a plurality of, for example four, cross girders arranged between the support girders. Mutually facing end sides and mutually opposite long sides bound a cuboidal guide framework with four vertical support girders. The width of the long sides of the guide framework is greater than the width of the long sides of the conveyance. The width of the end sides of the guide framework is greater than the width of the end sides of the conveyance.

In a conventional shaft hoisting plant, the conveyance is usually configured as a cage and consists of a stable steel profile frame with usually a number of levels. The end sides of the cage are open, while the side walls are clad with metal sheets, in particular perforated metal sheets. In order to convey passengers, the end-side access points are closed by a gate. In the case of a conveyance configured as a cage, the retaining bars with the energy-absorbing material arranged in between are arranged on the guide framework or directly on the conveyance, preferably parallel to the side walls of the cage, in order not to impede access to the end sides of the cage.

In order to introduce the braking forces during overwinding uniformly into the braking frame, in particular to avoid torques on the braking frame, on opposite sides of the guide framework, in each case at least one pair of the retaining bars are fastened to the lower and upper brace and extend parallel to the support girders between the braces. Preferably, the pairs of retaining bars are fastened centrally to the braces.

For positive driving of the braking frame in the guide framework, on opposite sides of the guide framework, in each case at least one guide profile is fastened to the lower and upper brace and extends parallel to the support girders, wherein guide shoes arranged on the braking frame engage around the guide profiles.

If the overwind brake device is located at the upper filling station of the winding path, supports arranged on the lower brace bear the load of the braking frame that is movable in the direction of the braking path. If the overwind brake device is arranged meanwhile in the shaft sump, the load of the braking frame can be absorbed by the plates of energy-absorbing material via the plow.

If the pairs of retaining bars are arranged parallel to the side walls of the conveyance, the guide profiles of the braking frame are arranged preferably parallel to the end sides of the conveyance.

BRIEF DESCRIPTION OF THE DRAWINGS

The overwind brake device according to the invention is explained in more detail in the following text with reference to the figures, in which.

DETAILED DESCRIPTION OF THE PREFERRED EMBODIMENTS

Figure 1:
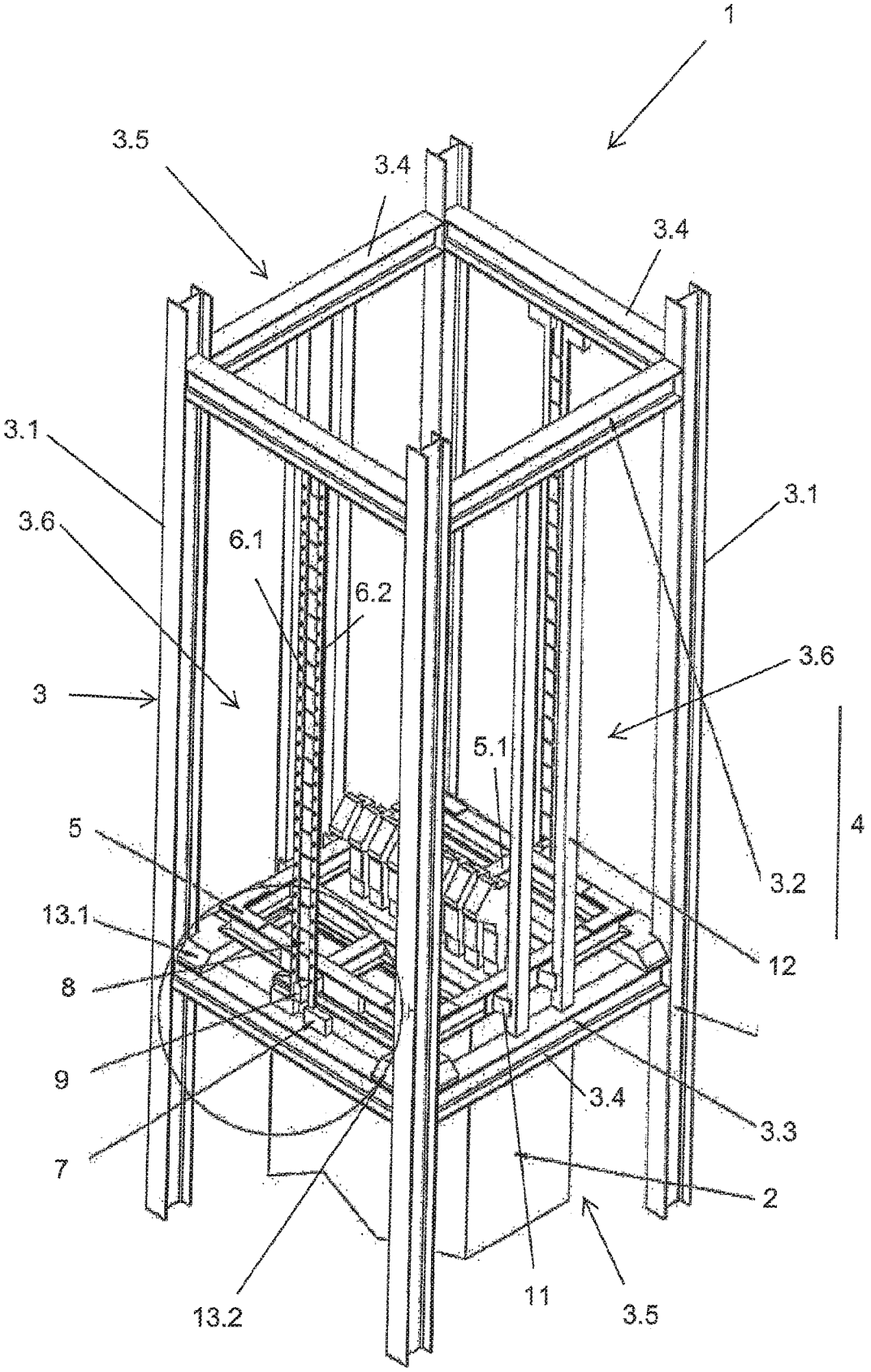
FIG. 1 is shows a perspective view of a first exemplary embodiment of an overwind brake device according to the invention, arranged at the upper filling station of a shaft hoisting plant, with a braking frame.

FIG. 1 shows a first exemplary embodiment of an overwind brake device (1) for a conveyance (2), configured as a cage, which is arranged at the end of the winding path above the upper filling station.

The overwind brake device (1) has a braking frame (5) which is positively driven in a longitudinal direction (4) in a guide framework (3), said braking frame (5) being set up to be struck by the conveyance (2) upon overwinding of the conveyance (2).

The guide framework (3) comprises four vertical support girders (3.1) and an upper brace (3.2) and a lower brace (3.3), which each consist of four cross girders (3.4) arranged between the support girders (3.1). The cuboidal guide framework (3) is bounded by opposite end sides (3.5) parallel to the open end sides of the cage (2), and opposite long sides (3.6) parallel to the side walls of the cage (2).

On the opposite long sides (3.6) of the guide framework (3), in each case one pair of retaining bars (6.1, 6.2) is fastened to the upper and lower brace (3.2, 3.3) by means of fastening strips (7). The pairs of retaining bars (6.1, 6.2) extend parallel to the support girders (3.1) and in the longitudinal direction (4) of the guide framework (3). Between the pairs of retaining bars (6.1, 6.2), plates (8) of energy-absorbing material are arranged one above another in the longitudinal direction (4). The material is in particular fiber-reinforced plastic.

The rectangular braking frame (5) is stiffened by struts (5.1) which at the same time form the impact surface for the conveyance (2) that strikes upon overwinding. From the outer periphery of the braking frame (5), in each case one plow (9) extends in the direction of the long sides (3.6) of the guide framework (3) on both sides, said plow (9) having a cutting edge (9.1) (cf. FIG. 2*b*) in the direction of the braking path (10) (cf. FIG. 2*c*). The plow (9) extends in a horizontal direction into the intermediate space between the retaining bars (6.1, 6.2) beneath the plates (8) of energy-absorbing material.

Furthermore, arranged at the outer edge of the braking frame (5) are a total of four guide shoes (11), which extend in the direction of the opposite end sides (3.5) of the guide framework (3). On the opposite end sides (3.5) of the guide framework (3), in each case two guide profiles (12) are fastened to the lower and upper brace (3.2, 3.3), symmetrically to the middle of the end side (3.5), and extend parallel to the support girders (3.1). The guide shoes (11) fastened to the braking frame (5) engage around the guide profiles (12). As a result, the braking frame (5) is positively driven along the guide profiles (12) in a tilt-free manner in the longitudinal direction (4) of the guide framework (1).

In FIG. 1, the braking frame (5) is in the starting position of the overwind brake device. In the starting position, the braking frame rests on supports (13.1, 13.2) which extend between the long-side cross girders (3.4) of the lower brace (3.3). The spacing between the supports (13.1, 13.2) is such that the rectangular braking frame (5) rests on the supports (13.1, 13.2) with the frame parts extending parallel to the end sides (3.5), but the conveyance (2) can pass easily through the cross section, narrowed by the supports (13.1, 13.2), in the guide framework (3).

Figure 2A:
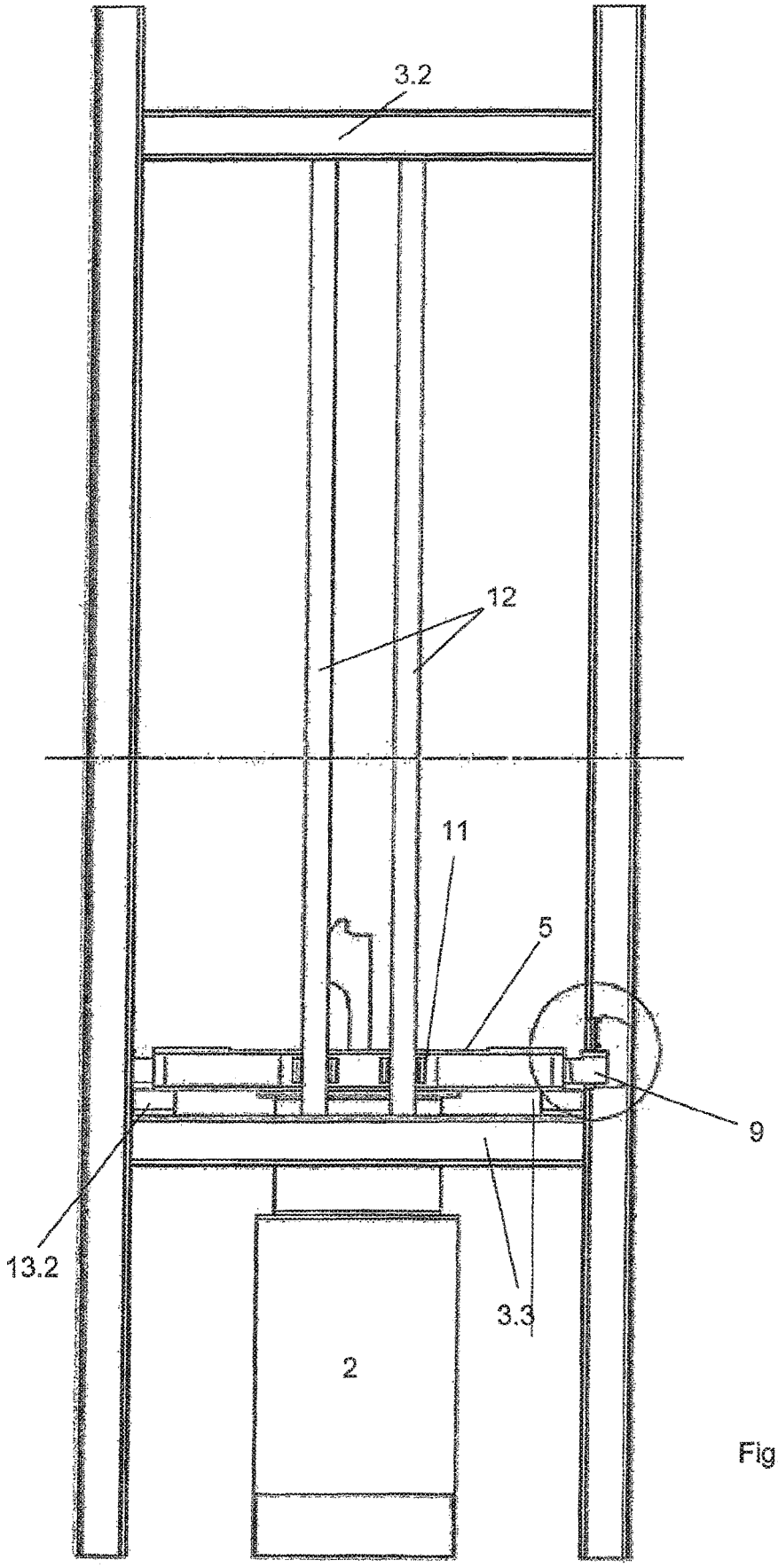
FIG. 2*a* is a front view of the overwind brake device according to FIG. 1 before overwinding.

In the following, the mode of operation of the overwind brake device (1) according to the invention is explained in more detail with reference to FIGS. 2*a*-2*c*. It is apparent from FIGS. 2*a* and 2*b* that the braking frame (5) rests on the supports (13.1, 13.2) in the starting position. The guide shoes (11) engage around the guide profiles (12).

Figure 2B:
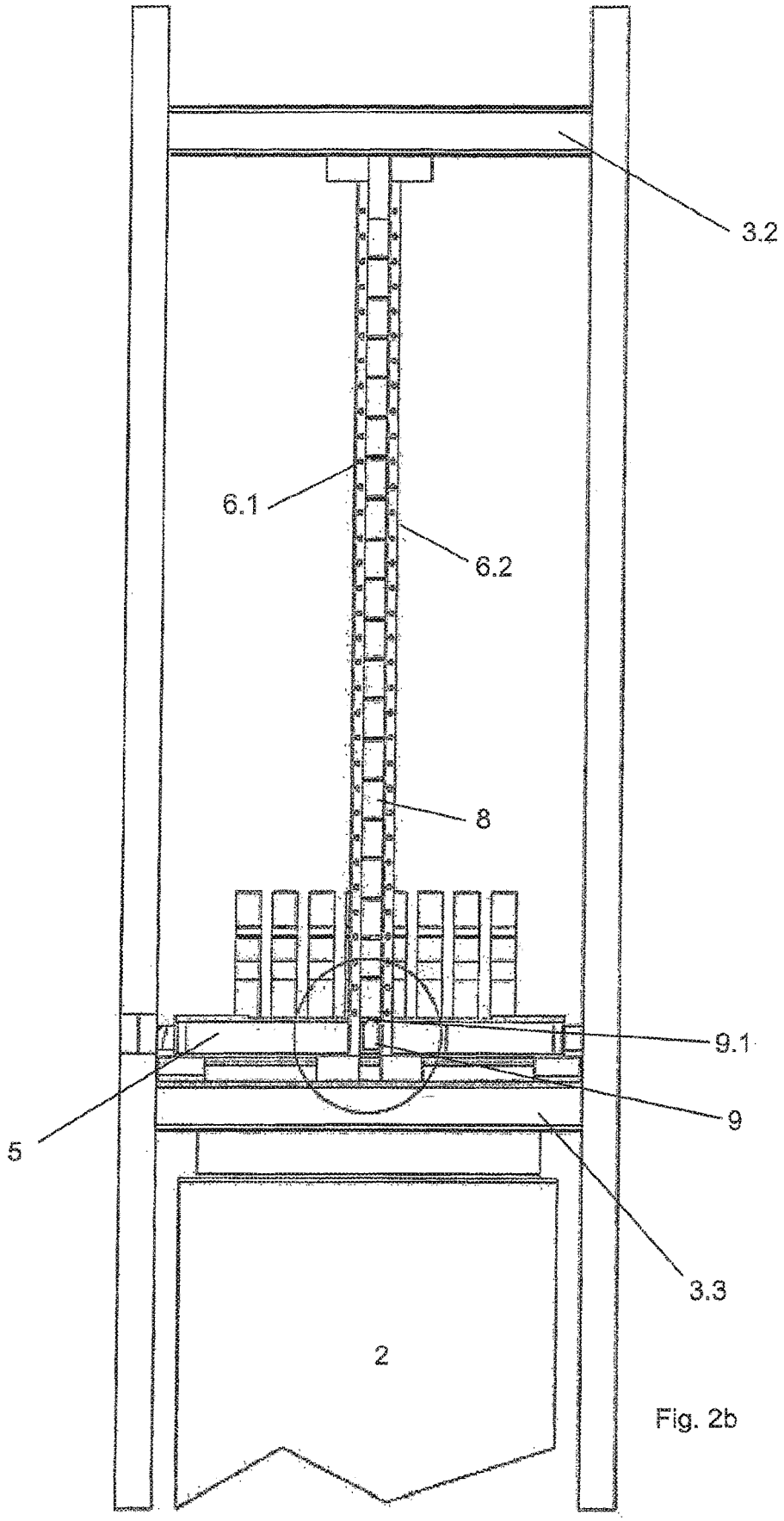
FIG. 2*b* is a side view of the overwind brake device according to FIG. 1 before overwinding, FIG. 2*c* a side view of the overwind brake device according to FIG. 1 after overwinding.

It is apparent from FIG. 2*b* how the cutting edge (9.1) of the plow (9) fastened to the braking frame (5) bears against the underside of the stack, fixed between the retaining bars (6.1, 6.2), of plates (8) of energy-absorbing material.

Figure 2C:
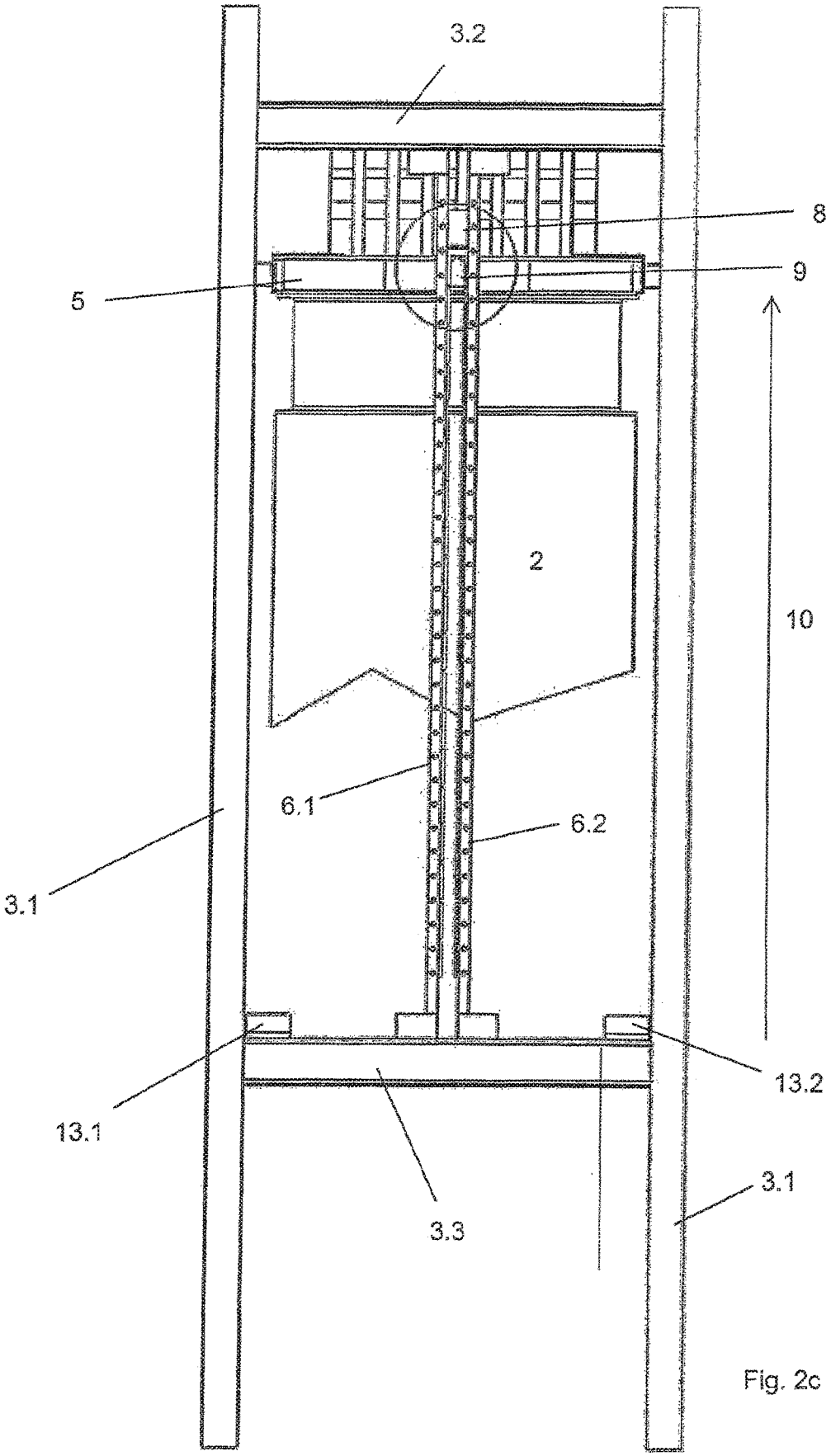

The conveyance (2) strikes the braking frame (5), which, as a result of the kinetic energy of the overwinding conveyance (2), moves upward along the braking path (10) in the guide framework (3) (cf. FIG. 2*c*). In the process, the plow (9) destroys the energy-absorbing material of the plates (8), and as a result brakes the conveyance (2) to a standstill at the end of the braking path (10).

Figure 3:
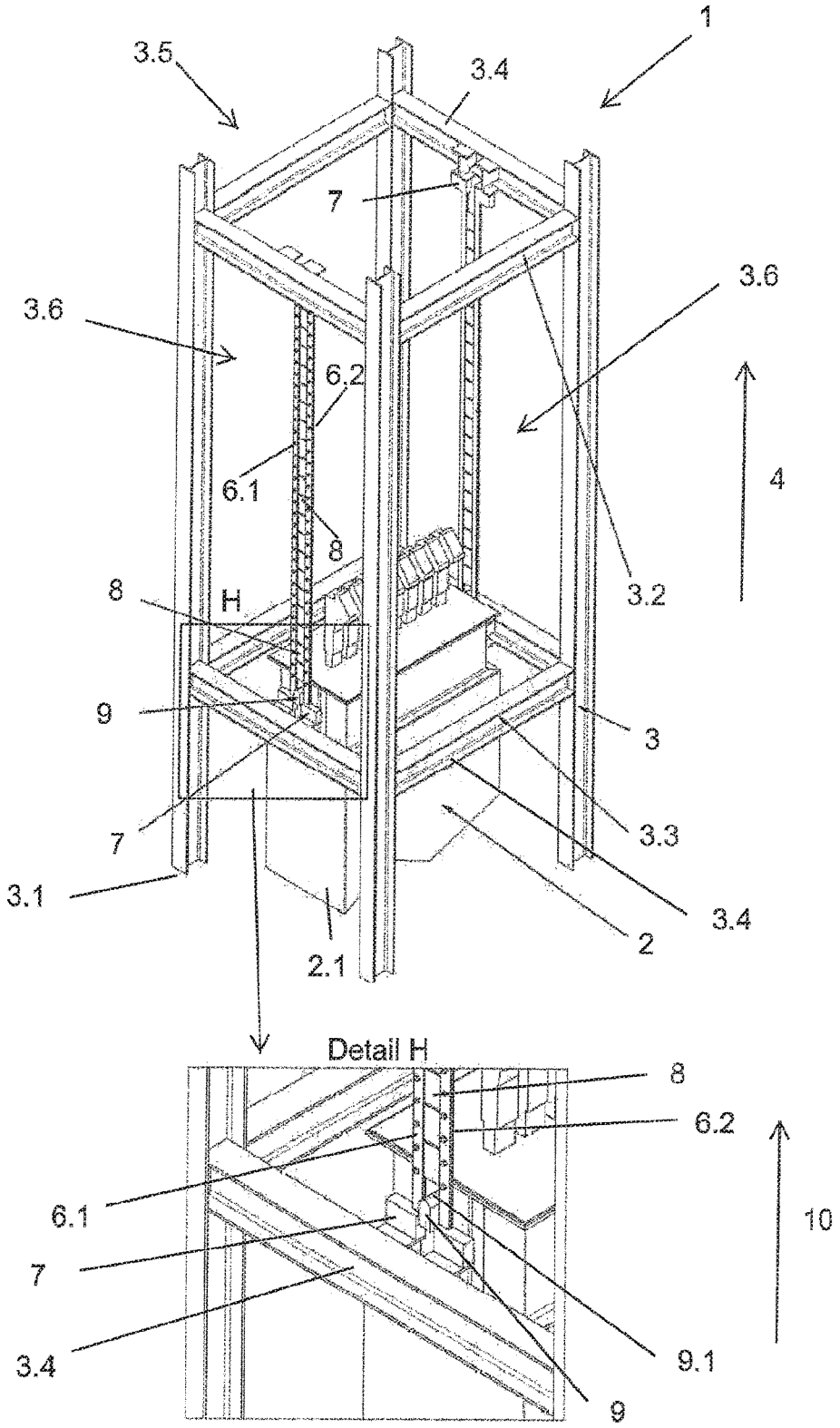
FIG. 3 is a perspective view of a second exemplary embodiment of an overwind brake device according to the invention, arranged at the upper filling station of a shaft hoisting plant, without a braking frame.

FIG. 3 shows a perspective view of a second exemplary embodiment of an overwind brake device arranged at the upper filling station of a shaft hoisting plant, but without a braking frame. Corresponding elements are provided with identical reference signs to those in the first exemplary embodiment.

The overwind brake device (1) has a guide framework (3), which has four vertical support girders (3.1) and an upper brace (3.2) and a lower brace (3.3), which each consist of four cross girders (3.4) arranged between the support girders (3.1). The cuboidal guide framework (3) is bounded by opposite end sides (3.5) parallel to the open end sides of the cage (2), and opposite long sides (3.6) parallel to the side walls (2.1) of the cage (2).

On the opposite long sides (3.6) of the guide framework (3), in each case one pair of retaining bars (6.1, 6.2) is fastened to the upper and lower brace (3.2, 3.3) by means of fastening strips (7). The pairs of retaining bars (6.1, 6.2) extend parallel to the support girders (3.1) and in the longitudinal direction (4) of the guide framework (3). Between the pairs of retaining bars (6.1, 6.2), plates (8) of energy-absorbing material are arranged one above another in the longitudinal direction (4). The material is in particular fiber-reinforced plastic.

From the side walls (2.1) of the conveyance (2), in each case one plow (9) extends in the direction of the long sides (3.6) of the guide framework (3) on both sides, said plow (9) having a cutting edge (9.1) in the direction of the braking path (10). The plow (9) extends in a horizontal direction into the intermediate space between the retaining bars (6.1, 6.2) beneath the plates (8) of energy-absorbing material.

It is apparent from FIG. 3, detail H, how the cutting edge (9.1) of the plow (9) bears against the underside of the stack, fixed between the retaining bars (6.1, 6.2), of plates (8) of energy-absorbing material. The overwinding conveyance (2) moves upward along the braking path (10) in the guide framework (3). In the process, the plow (9) destroys the energy-absorbing material of the plates (8), and as a result brakes the conveyance (2) to a standstill.

Figure 4:
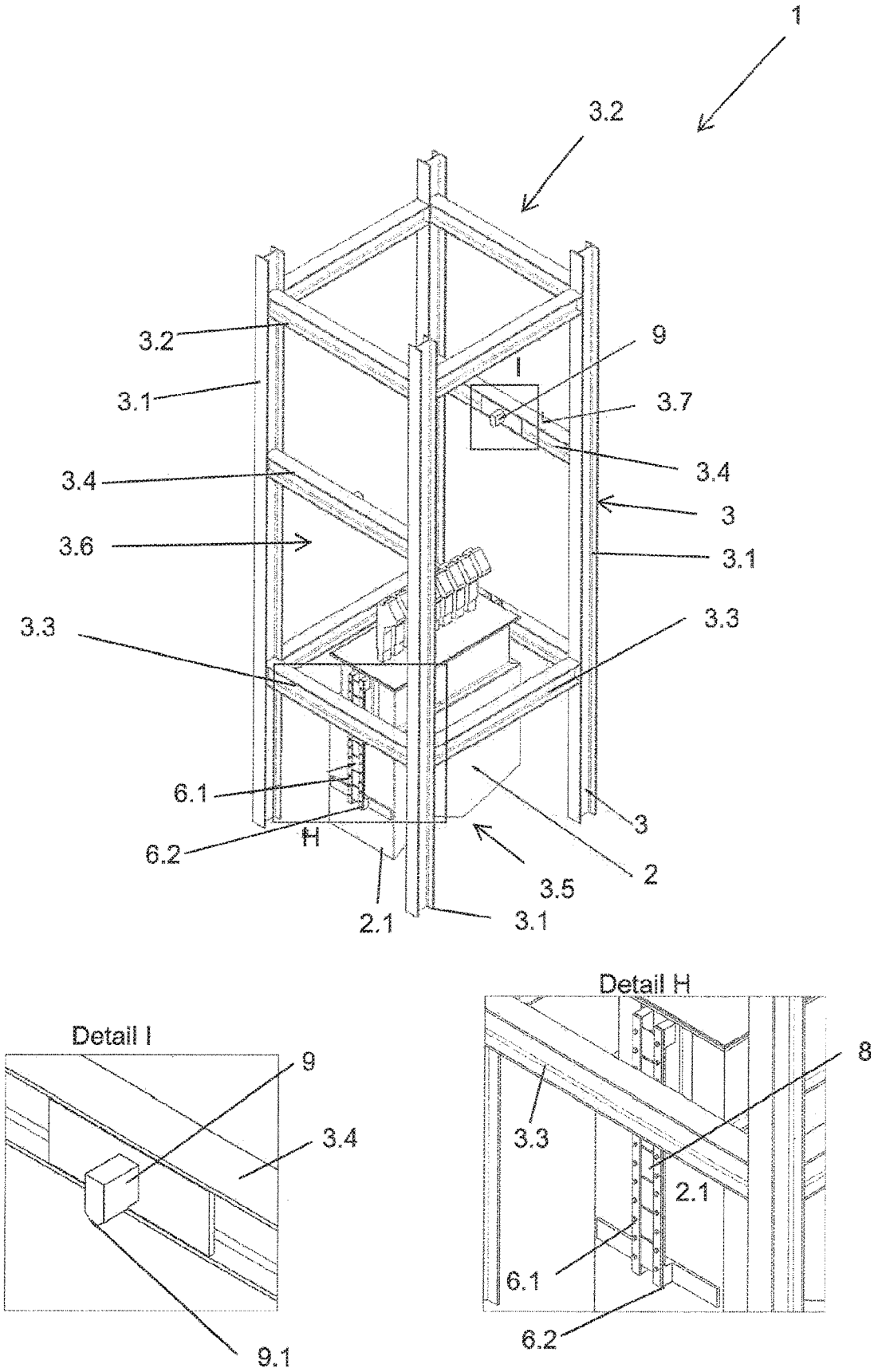
FIG. 4 is a perspective view of a third exemplary embodiment of an overwind brake device according to the invention, arranged at the upper filling station of a shaft hoisting plant, without a braking frame.

FIG. 4 shows a perspective view of a third exemplary embodiment of an overwind brake device arranged at the upper filling station of a shaft hoisting plant, but without a braking frame. Corresponding elements are provided with identical reference signs to those in the first exemplary embodiment.

The overwind brake device (1) has a guide framework (3), which has four vertical support girders (3.1) and an upper brace (3.2) and a lower brace (3.3), which each consist of four cross girders (3.4) arranged between the support girders (3.1). Located between the upper brace (3.2) and the lower brace (3.3) is a further, central brace (3.7), which comprises two cross girders (3.4) arranged in a parallel manner on opposite sides of the guide framework (3). The cuboidal guide framework (3) is bounded by opposite end sides (3.5) parallel to the open end sides of the cage (2), and opposite long sides (3.6) parallel to the side walls (2.1) of the cage (2).

On the opposite side walls (2.1) of the cage (2), in each case one pair of retaining bars (6.1, 6.2) is fastened centrally. The pairs of retaining bars (6.1, 6.2) extend parallel to the support girders (3.1) and in the longitudinal direction (4) of the winding and overwind path. Between the pairs of retaining bars (6.1, 6.2), plates (8) of energy-absorbing material are arranged one above another in the longitudinal direction (4). The material is in particular fiber-reinforced plastic.

From the cross girders (3.4) of the central brace (3.7) of the guide framework (3), in each case one plow (9) extends in the direction of the two side walls (2.1) of the cage (2), said plow (9) having a cutting edge (9.1) in the opposite direction to the direction of the braking path (10). The plow (9) extends in a horizontal direction into the intermediate space between the retaining bars (6.1, 6.2) above the plates (8) of energy-absorbing material. The overwinding conveyance (2) moves upward along the braking path (10) in the guide framework (3). In the process, the stationary plow (9) destroys the energy-absorbing material of the plates (8) between the retaining bars (6.1, 6.2), and as a result brakes the conveyance (2) to a standstill at the end of the braking path (10).

| No. | Designation |
|---|---|
| 1. | Overwind brake device |
| 2. | Conveyance |
| 2.1 | Side walls |
| 3. | Guide framework |
| 3.1 | Support girders |
| 3.2 | Upper brace |
| 3.3 | Lower brace |
| 3.4 | Cross girders |
| 3.5 | End sides |
| 3.6 | Long sides |
| 3.7 | Central brace |
| 4. | Longitudinal direction |
| 5. | Braking frame |
| 5.1 | Struts |
| 6.1 | Retaining bar |
| 6.2 | Retaining bar |
| 7. | Fastening strips |
| 8. | Plates of energy-absorbing material |
| 9. | Plow |
| 9.1 | Cutting edge |
| 10 | Braking path |
| 11. | Guide shoes |
| 12. | Guide profiles |
| 13.1 | Support |
| 13.2 | Support |

The invention claimed is:

1. A shaft hoisting plant comprising:

a conveyance, an overwind brake device for the conveyance, a travel path for the conveyance extending in a longitudinal direction, and an overwind path adjoining one of a lower end or an upper end of the travel path, wherein the overwind brake device comprises:

a pair of retaining bars extending parallel to the longitudinal direction of the travel path, plates of energy-absorbing material arranged between the retaining bars, the plates being arranged one above another in the longitudinal direction between the retaining bars, and a plow movable relative to the retaining bars such that, upon overwinding of the conveyance, the plow at least one of deforms and destroys the plates of energy-absorbing material between the retaining bars, wherein either the plow is movable and the retaining bars are stationary on the overwind path or the plow is stationary on the overwind path and the retaining bars are movable.

2. The shaft hoisting plant as claimed in claim 1, wherein the plow is arranged on the conveyance.

3. The shaft hoisting plant as claimed in claim 1, wherein the retaining bars are arranged on the conveyance.

4. The shaft hoisting plant as claimed in claim 1, wherein the overwind brake device has a braking frame that is movable in the longitudinal direction and guided by a guide framework, said braking frame being set up to be contacted by and moved along the overwind path by the conveyance upon overwinding of the conveyance, the retaining bars are fastened to the guide framework, and the plow is arranged on the braking frame.

5. The shaft hoisting plant as claimed in claim 1, wherein the energy-absorbing material of the plates is a fiber composite material.

6. The shaft hoisting plant as claimed in claim 5, wherein the fiber composite material is a fiber-reinforced plastic.

7. The shaft hoisting plant as claimed in claim 5, wherein the fiber composite material is reinforced by at least one of inorganic fibers, organic fibers, and metallic fibers.

8. The shaft hoisting plant as claimed in claim 6, wherein the fiber-reinforced plastic is a continuous fiber-reinforced thermoplastic.

9. The shaft hoisting plant as claimed in claim 7, wherein the fiber-reinforced plastic is a continuous fiber-reinforced thermoplastic.

10. The shaft hoisting plant as claimed in claim 4, wherein the guide framework has vertical support girders, an upper brace, and a lower brace, each of the upper brace and the lower brace consisting of cross girders arranged between the support girders.

11. The shaft hoisting plant as claimed in claim 10, wherein at least two pairs of retaining bars are arranged on two first opposite sides of the guide framework, each of the retaining bars are fastened to the lower brace and the upper brace and extend parallel to the support girders between the upper brace and the lower brace.

12. The shaft hoisting plant as claimed in claim 11, wherein at least one guide profile on two second opposite sides of the guide framework is fastened to the lower brace and the upper brace and extends parallel to the support girders, and guide shoes engaging around the guide profiles are arranged on the braking frame, the guide shoes and guide profiles guiding the braking frame along the overwind path.

13. The shaft hoisting plant as claimed in claim 12, wherein the first opposite sides of the guide framework are different than the second opposite sides of the guide framework.

14. The shaft hoisting plant as claimed in claim 10, further comprising supports supporting the braking frame, the supports arranged on the lower brace.

15. The shaft hoisting plant as claimed in claim 5, wherein the guide framework has vertical support girders an upper brace and a lower brace, which each of the upper brace and the lower brace consists of cross girders arranged between the support girders.

16. The shaft hoisting plant as claimed in claim 15, wherein at least two pairs of the pair of retaining bars are arranged on two opposite sides of the guide framework, each of the retaining bars are fastened to the lower brace and the upper brace and extend parallel to the support girders between the upper brace and the lower brace.

* * * * *